US008945319B2

(12) United States Patent
Tachibana et al.

(10) Patent No.: US 8,945,319 B2
(45) Date of Patent: Feb. 3, 2015

(54) MANUFACTURING METHOD AND MANUFACTURING APPARATUS OF HOT-ROLLED STEEL SHEET

(75) Inventors: Hisayoshi Tachibana, Kashima (JP); Shigemasa Nakagawa, Narashino (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 195 days.

(21) Appl. No.: 13/598,162

(22) Filed: Aug. 29, 2012

(65) Prior Publication Data

US 2012/0318414 A1 Dec. 20, 2012

Related U.S. Application Data

(63) Continuation of application No. PCT/JP2011/055266, filed on Mar. 7, 2011.

(30) Foreign Application Priority Data

Mar. 11, 2010 (JP) ..... 2010-054650

(51) Int. Cl.

| | |
|---|---|
| ***C21D 8/02*** | (2006.01) |
| ***C21D 11/00*** | (2006.01) |
| ***B21C 51/00*** | (2006.01) |
| ***B21B 37/74*** | (2006.01) |
| *B21B 45/00* | (2006.01) |
| *B21B 45/02* | (2006.01) |
| *B21B 1/26* | (2006.01) |
| *B21B 38/00* | (2006.01) |
| *B21B 45/06* | (2006.01) |

(52) U.S. Cl.

CPC ..... *B21C 51/00* (2013.01); *B21B 37/74* (2013.01); *B21B 45/004* (2013.01); *B21B 45/0218* (2013.01); *B21B 1/26* (2013.01); *B21B 38/006* (2013.01); *B21B 45/06* (2013.01); *B21B 2265/20* (2013.01)

USPC ..... 148/511; 148/567; 148/654; 266/259; 266/87; 266/115; 75/201; 75/364; 75/366.2

(58) Field of Classification Search

None

See application file for complete search history.

(56) References Cited

FOREIGN PATENT DOCUMENTS

| | | |
|---|---|---|
| CN | 1246392 | 3/2000 |
| CN | 1106233 | 4/2003 |

(Continued)

OTHER PUBLICATIONS

Machine-English translation of Japanese patent No. 2005-230875, Kimura Kazuyoshi et al., Sep. 2, 2005.*

(Continued)

*Primary Examiner* — Deborah Yee

(74) *Attorney, Agent, or Firm* — Clark & Brody

(57) ABSTRACT

Provided is a manufacturing method of a hot-rolled steel sheet which enables manufacturing of a hot-rolled steel sheet having excellent surface properties and a fine structure. The manufacturing method of a hot-rolled steel sheet uses a heating device, descaling device, row of finishing mills, cooling device disposed in the row of finishing mills, and rapid cooling device disposed immediately after the row of finishing mills, and the operations of the heating device, cooling device and rapid cooling device are controlled, thereby controlling a temperature T1 of the material to be rolled on an entry side of the row of finishing mills, a temperature T2 of the material to be rolled on an entry side of a final stand in the row of finishing mills, and a temperature T3 of the material to be rolled on an exit side of the rapid cooling device.

12 Claims, 3 Drawing Sheets

(56) References Cited

FOREIGN PATENT DOCUMENTS

| | | |
|---|---|---|
| CN | 1412333 | 4/2003 |
| JP | 46-23136 | 7/1971 |
| JP | 47-37829 | 9/1972 |
| JP | 2002-11502 | 1/2002 |
| JP | 2005-169454 | 6/2005 |
| JP | 2006-55884 | 3/2006 |
| JP | 4029871 | 10/2007 |
| JP | 4079098 | 4/2008 |
| JP | 2010-105027 | 5/2010 |

OTHER PUBLICATIONS

Machine-English translation of Japanese patent No. 2006-55884, Kimura Kazyoshi, Mar. 2, 2006.*

Machine-English translation of Japanese patent No. 2002-11502, Kimura Kazuyoshi et al, Jan. 15, 2002.*

* cited by examiner

MANUFACTURING METHOD AND MANUFACTURING APPARATUS OF HOT-ROLLED STEEL SHEET

TECHNICAL FIELD

The present invention relates to a manufacturing method and a manufacturing apparatus of a hot-rolled sheet. It particularly relates to a manufacturing method and a manufacturing apparatus of a hot-rolled sheet focusing on temperature control of a material to be rolled by a finishing mill.

BACKGROUND ART

A hot-rolled steel sheet is manufactured in the following way: a slab heated in a heating furnace is roughly rolled in a roughing mill to become a roughly rolled material (hereinafter sometimes referred to as a "rough bar"); thereafter, the rough bar, which has been transported to a finishing mill by a transporting table, is rolled into a predetermined size in the finishing mill; then after going through a cooling process in which it is cooled in predetermined conditions, it is finally coiled by a coiler.

Among the hot-rolled steel sheets manufactured in this manner, a steel sheet for automobiles, structural materials and the like is required to have excellent mechanical properties such as strength, workability, and toughness. In order to enhance these mechanical properties comprehensively, it is effective to refine the structure of the steel sheet, and therefore a number of methods for obtaining a steel sheet with a fine structure have been sought. Further, if the structure of the steel sheet is refined, it is possible to obtain a high-strength hot-rolled steel sheet having excellent mechanical properties even if the amount of alloy elements to be added is reduced.

As a method of refining the structure of the steel sheet, it is known that large reduction rolling is carried out especially in the later stage of finish rolling to refine austenite grains and to accumulate rolling strains in the steel sheet, thereby obtaining fine ferrite grains after finish rolling. The finishing mill is constituted by a plurality of stands, and the steel sheet accumulates strains inside by being rolled; however, since the strains are released as time passes, it is desirable to roll the steel sheet within a short period of time in order to accumulate the rolling strains. Further, in view of inhibiting recrystallization or recovery of the austenite grains and facilitating the ferrite transformation, it is effective to rapidly cool the steel sheet to a temperature of 600° C. to 750° C. as quickly as possible after the finish rolling. In addition, in order to enable uniformity of the mechanical properties of the steel sheet, the ferrite grains need to be in the same predetermined grain size, and the temperatures of the steel sheet at a time of starting rapid cooling and at a time of completing the rapid cooling need to be strictly controlled to predetermined temperatures.

On the other hand, when a steel sheet is rolled, it will be oxidized by oxygen in the air, and oxidized scales will be formed on the surface of the steel sheet. The oxidized scales formed are removed by a descaler which is arranged on an entry side of the finishing mill. However, if they are not removed enough, the cooling properties at a time of rapid cooling after rolling will vary between the area where the oxidized scales have been removed and the area where they remain. Accordingly, the temperature of the steel sheet cannot be controlled strictly, causing the mechanical properties thereof to deteriorate. Furthermore, the surface properties of the hot-rolled steel sheet as a finished product also deteriorate.

Therefore, in order to manufacture a hot-rolled steel sheet having excellent mechanical properties and favorable surface properties, it is necessary to fully remove the oxidized scales. At a time of removing the oxidized scales by spraying high-pressure water at the steel sheet or removing them by a descaler (a descaling device), if the oxidized scales are too thin, they cannot be removed well. So in order to make the oxidized scales grow thick so that they can be easily removed, it is necessary to heat the rough bar up to a predetermined temperature and to facilitate growth of the oxidized scales.

For example, in order to manufacture a high tensile steel sheet having both strength and workability, it is effective to add Si to the composition of the steel sheet. However, when the steel sheet contains Si, an oxide mainly composed of iron and Si will be produced at a boundary between the base material and the oxidized scales. A melting point of this oxide is approximately 1100° C. When the oxide is in a solid state, it interrupts transfer of iron ions supplied from the base material that is necessary for the oxidized scales to grow, thus preventing the oxidized scales from growing thick. Therefore, when the steel sheet contains Si, heating the rough bar to 1100° C. or more will cause the oxide mainly composed of iron and Si to melt, enabling iron ions to be supplied and the oxidized scales to grow thick. As a result, the oxidized scales can be easily removed by the descaler.

On the contrary, when this oxide does not melt and the oxidized scales remain thin, the oxidized scales that cannot be removed by the descaler will remain on the surface of the steel sheet and will be further oxidized by oxygen in the atmosphere, to turn from ferrous oxide to red ferric oxide. This ferric oxide not only changes the aforementioned cooling properties at the time of rapid cooling, but also largely changes emissivity of the surface of the steel sheet when it remains on the steel sheet, thus causing errors in measurement values obtained by a radiation thermometer. As such, when the oxide mainly composed of iron and Si does not melt, not only will it be extremely difficult to strictly control the temperature of the hot-rolled steel sheet, but also problems will arise in the quality control.

As the technique related to a manufacturing method and a manufacturing apparatus of such a hot-rolled steel sheet, Patent Document 1 for example discloses a manufacturing facility of a steel strip comprising in the following mentioned order: rough machining equipment which subjects a hot slab to single or multiple pass reduction in the sheet thickness direction to obtain a rough bar; first rapid cooling equipment which is arranged directly near an exit side of the rough machining equipment and cools the rough bar; coilbox equipment which coils the cooled rough bar; rapid heating equipment which heats the coiled rough bar while uncoiling it; and finishing equipment which gives rolling reduction in the sheet thickness direction to the heated rough bar to obtain a steel strip. Further, Patent Document 1 discloses a manufacturing method of a steel strip using such a manufacturing facility of a steel strip; and the technique described in Patent Document 1 aims to manufacture a steel strip having an ultra fine grain structure. In addition, Patent Document 2, with an aim to manufacture a steel sheet having excellent mechanical properties and surface properties, discloses a manufacturing method of a hot rolled steel sheet wherein in manufacturing a hot-rolled steel sheet by roughly rolling a heated steel slab with a roughing mill to obtain a rough bar and carrying out finish rolling with a finishing mill while controlling the temperature of the steel sheet on an exit side of the finishing mill to a target value by heating the rough bar with a heating device arranged on an entry side of the finishing mill comprising a plurality of stands and/or by cooling the rough bar with a cooling device arranged in at least one interstand space among the plurality of stands, the temperature of the rough bar on the entry side of the finishing mill is predicted before starting the rough rolling, based on a predicted value of the temperature of the rough bar on the exit side of the roughing mill; and a preset value of a rolling speed of finish rolling and/or a preset value of a thickness of the rough bar are corrected and set such that the predicted value of the temperature of the rough bar on the entry side of the finishing mill becomes a target value or above. Further, Patent Document 2 discloses a manufacturing apparatus of a hot-rolled steel sheet to which this manufacturing method can be applied.

CITATION LIST

Patent Literature

Patent Document 1: Japanese Patent Application Laid-Open No. 2005-169454

Patent Document 2: Japanese Patent No. 4079098

SUMMARY OF INVENTION

Problems to be Solved by the Invention

The technique disclosed in Patent Document 1 aims to obtain refined ferrite grains after finish rolling by refining the austenite grain size of the rough bar before finish rolling. As a method of refining the austenite grain size, reverse transformation is utilized, which is to cool the rough bar to cause it to undergo bainite transformation and thereafter induce reverse transformation through reheating to obtain a fine austenite structure. In Example of Patent Document 1, a manufacturing method is described in which a rough bar having a temperature of 1000° C. is cooled down to 350° C. and thereafter heated up to 900° C.

However, in order to increase the temperature of the rough bar by as much as 550° C. from 350° C. to 900° C., a tremendous amount of energy is required and the heating device needs to be large. Further, in order to fully remove oxidized scales, it is desirable to increase the temperature of the rough bar before finish rolling up to 1100° C. or more. However, this requires increase of the temperature of the rough bar by as much as 750° C. or more from 350° C. to 1100° C. or more, thus leading a bigger problem. As described above, the technique in Patent Document 1 requires extremely large energy consumption and large equipment, which is thus unfavorable not only because it causes increase in manufacturing costs of a product but also in view of $Co_2$ reduction.

On the other hand, the technique disclosed in Patent Document 2 is not a technique of manufacturing a steel sheet having a fine structure. However, it is to avoid a large-sized heating device, and to efficiently increase the temperature on the entry side of the finishing mill up to a predetermined temperature and control the temperature on the exit side of the finishing mill to a predetermined temperature. Specifically in terms of the technique of simultaneously controlling the temperatures of the steel sheet on the entry side and on the exit side of the finishing mill, Patent Document 2 and the present invention share similarity in many points.

Nevertheless in the technique disclosed in Patent Document 2, although the sheet thickness of the rough bar and the finish rolling speed are corrected as a means to controlling the temperature of the steel sheet efficiently, in order to manufacture a steel sheet with a fine grain structure, strains need to be accumulated at the time of finish rolling and it is not desirable to slow down the finish rolling speed. Thus, the finish rolling speed cannot be changed freely just for the purpose of controlling the temperature.

Furthermore, because a strong cooling capability is needed in cooling a steel sheet after finish rolling, a rapid cooling device with a high water volume density is used which sprays a large amount of cooling water in a narrow range. However, a large amount of cooling water is difficult to increase or decrease within a short period of time and the adjustment of the cooling capability needs to be minimized; therefore, it is difficult to deal with the changes in the finish rolling speed such as accelerated rolling. However, in the technique of Patent Document 2, the heating device is the only means for compensating for the temperature decrease on the tail end portion of the rough bar which stays on the entry side of the finishing mill during finish rolling. In order to minimize the energy required for heating, it is necessary to shorten the time period in which the tail end portion of the rough bar stays on the entry side of the finishing mill and therefore necessary to perform accelerated rolling to speed up the finish rolling speed gradually, which inevitably causes changes in the finish rolling speed.

Accordingly, an object of the present invention is to provide a manufacturing method and a manufacturing apparatus of a hot-rolled steel sheet with which a hot-rolled steel sheet having a fine structure and excellent mechanical properties and surface properties can be manufactured at low cost.

Means for Solving the Problems

There are three following conditions necessary for manufacturing a steel sheet having a fine structure. The first condition is refining austenite grains and accumulating rolling strains by carrying out large reduction rolling in the later stage of finish rolling. The second condition is rapid cooling immediately after finish rolling and strict control of the steel sheet temperatures at the time of starting the rapid cooling and at the time of completing the rapid cooling. The third condition is removal of oxidized scales.

As a result of their intensive studies, the inventors have devised a means of realizing these three conditions at low cost.

For refinement of austenite grains and accumulation of rolling strains as the first condition, a gap between finishing rolls for ensuring necessary large rolling reduction is set, and a finish rolling speed is set such that it enables a rolling time interval that does not allow the rolling strains to be released. The finish rolling speed is desirably set such that the rolling time interval between a stand on the most downstream side of the row of finishing mills and a stand next thereto on the upstream side is within one second.

The rapid cooling immediately after finish rolling, which is the second condition, is preformed by a rapid cooling device which is disposed on an exit side of a final stand in the row of finishing mills, at least a part of which is disposed in the final stand, and which is capable of spraying cooling water at a steel sheet from both faces of the steel sheet at a water volume density of 10 $m^3/(m^2 \cdot min)$ or more for one face of the steel sheet.

Next, descriptions will be given on the control of the steel sheet temperature at the time of starting rapid cooling and at the time of completing the rapid cooling, which is the second condition, and on the removal of oxidized scales, which is the third condition. In order to achieve these, it is necessary to maintain the finish rolling speed necessary for accumulating strains and not to change the cooling capability of the rapid cooling device immediately after finish rolling as much as possible during rapid cooling of the steel sheet. Therefore, rolling at a steady speed, in which the rolling speed is restricted and changes in the speed do not occur, is required.

It is possible, by only using a heating device, to keep the temperature of the rough bar on the entry side of the finishing mill at a temperature suitable for removing oxidized scales under the condition that the finish rolling speed is steady. However, the heating device is forced to supply thermal energy to compensate even for the decrease in the temperature, due to air cooling, of the tail end portion of the rough bar staying on the entry side of the finishing mill during finish rolling, consequently requiring a large-sized heating device and enormous amount of energy. In this respect, installing a coilbox serving as a device for supplementing heat loss can inhibit the temperature decrease on the tail end portion of the rough bar; and by combining it with a small-sized heating device, it is possible to maintain a predetermined temperature with a small amount of energy.

Further, even in a minimill that starts from thin slab continuous casting, by keeping the temperature on the entry side of the finishing mill at a predetermined value or more, the oxidized scales can be easily removed. In order to reduce costs for building equipment, a minimill often employs an inefficient gas burning type furnace for a heating device on the entry side of the finishing mill. Even with a configuration employing such a minimill, reduction of a total cost including the cost of equipment can be attained.

Next, in order to keep, at a predetermined temperature, the temperature of the steel sheet at the time of starting rapid cooling immediately after finish rolling, a cooling device arranged in the row of finishing mills is used; and the number of cooling headers in the cooling device or the amount of cooling water is adjusted, or both the number of cooling headers and the amount of cooling water are appropriately set to thereby control the steel sheet to have a predetermined temperature.

Lastly in order to keep, at a predetermined temperature, the temperature of the steel sheet after completing the rapid cooling, the number of cooling headers in the rapid cooling device or the amount of cooling water is adjusted, or both the number of cooling headers and the amount of cooling water are appropriately set to thereby control the temperature. The temperature of the steel sheet at the time of starting rapid cooling is kept at the predetermined temperature, the speed of the steel sheet does not change during rapid cooling of the steel sheet, and the oxidized scales are fully removed. Therefore, as long as initial setting is properly done, the temperature of the steel sheet can be controlled with high precision even without modifying the setting of the rapid cooling device during cooling.

Hereinafter, the present invention will be described. Although the reference numerals given in the accompanying drawings are shown in parentheses to make the present invention easy to understand, the present invention is not limited to the embodiments shown in the drawings.

A first aspect of the present invention is a manufacturing method of a hot-rolled steel sheet wherein in manufacturing a hot-rolled steel sheet using a heating device (5, 14) which heats a material (1) to be rolled, a descaling device (6) disposed on a more downstream side in a transporting direction of the material to be rolled than the heating device, a row (7) of finishing mills disposed on a more downstream side in the transporting direction of the material to be rolled than the descaling device, a cooling device (8) disposed in the row of finishing mills, and a rapid cooling device (9) disposed immediately after the row of finishing mills, the operations of the heating device, cooling device and rapid cooling device are controlled, thereby controlling a temperature T1 of the material to be rolled which is on an entry side of the row of finishing mills, a temperature T2 of the material to be rolled which is on an entry side of a final stand (7*g*) in the row of finishing mills, and a temperature T3 of the material to be rolled which is on an exit side of the rapid cooling device.

Here, in the present invention, the "rapid cooling device (9) disposed immediately after the row of finishing mills" refers to a rapid cooling device (9) disposed such that it is capable of rapidly cooling the material (1) to be rolled that has just been finish-rolled by the final stand (7*g*) in the row (7) of finishing mills. More specifically, for example it refers to a raid cooling device (9) at least a part of which is disposed in the final stand (7*g*) of the row (7) of finishing mills, and which can decrease the temperature of the material (1) to be rolled at a rate of 600° C./s or more, preferably 1000° C./s or more by spraying cooling water all over the material (1) to be rolled in the sheet thickness direction thereof from both faces of the material (1) to be rolled at a water volume density of 10 $m^3/(m^2 \cdot min)$ or more for one face of the material (1) to be rolled.

In the above first aspect of the present invention, the temperature of the material (1) to be rolled may be increased to 1100° C. or more by using the heating device (5, 14).

Further, in the first aspect of the present invention, an induction heating device (5) and/or a gas burning furnace (14) are preferably included in the heating device.

Further, in the first aspect of the present invention, the material (1) to be rolled which is to be heated by the heating device may be roughly rolled by a roughing mill (3) disposed on a more upstream side in the transporting direction of the material (1) to be rolled than the heating device (5, 14).

Furthermore, in the first aspect of the present invention, it is preferable to arrange a coilbox (4) which coils the material (1) to be rolled on a more upstream side in the transporting direction of the material (1) to be rolled than the heating device (5), and to heat, by the heating device, the material to be rolled which has been removed from the coilbox.

Additionally, in the first aspect of the present invention, the temperature T1, temperature T2, and temperature T3 are preferably controlled based on a detection result of a temperature of the material to be rolled which is detected by a temperature detecting device (10) disposed on a more upstream side in the transporting direction of the material (1) to be rolled than the heating device (5).

A second aspect of the present invention is a manufacturing apparatus (30, 31, 32) of a hot-rolled steel sheet comprising: a heating device (5, 14) which heats a material (1) to be rolled; a descaling device (6) disposed on a more downstream side in a transporting direction of the material to be rolled than the heating device; a row (7) of finishing mills disposed on a more downstream side in the transporting direction of the material to be rolled than the descaling device; a cooling device (8) disposed in the row of finishing mills; a rapid cooling device (9) disposed immediately after the row of finishing mills; and a control device (20) capable of controlling the operations of the heating device, cooling device and rapid cooling device, wherein the operations of the heating device, cooling device and rapid cooling device are controlled by the control device, thereby controlling a temperature T1 of the material to be rolled which is on an entry side of the row of finishing mills, a temperature T2 of the material to be rolled which is on an entry side of a final stand (7*g*) in the row of finishing mills, and a temperature T3 of the material to be rolled which is on an exit side of the rapid cooling device.

In the above second aspect of the present invention, the heating device (5, 14) may be configured to be capable of increasing the temperature of the material (1) to be rolled to 1100° C. or more.

Further, in the second aspect of the present invention, an induction heating device (5) and/or a gas burning furnace (14) are preferably included in the heating device.

Furthermore, in the second aspect of the present invention, a roughing mill (3) which roughly rolls the material (1) to be rolled may be arranged on a more upstream side in the transporting direction of the material (1) to be rolled than the heating device (5, 14).

Moreover, in the second aspect of the present invention, a coilbox (4) which coils the material (1) to be rolled is preferably arranged on a more upstream side in the transporting direction of the material (1) to be rolled than the heating device (5).

Additionally, in the second aspect of the present invention, it is preferable to dispose a temperature detecting device (10) on a more upstream side in the transporting direction of the material (1) to be rolled than the heating device (5), and to control the temperature T1, temperature T2, and temperature T3 based on a detection result of a temperature of the material to be rolled which is detected by the temperature detecting device.

Effects of the Invention

In the first aspect of the present invention, the operations of the heating device (5, 14), cooling device (8), and rapid cooling device (9) are controlled, to thereby control the temperature T1, temperature T2, and temperature T3. With this configuration, the amount of energy necessary to increase the temperature T1 to a target temperature is small compared to the conventional techniques, therefore enabling reduction of equipment costs and energy costs. In addition, it is unnecessary to perform accelerated rolling, thus preventing changes in the finish rolling speed that can be a disturbance to temperature controls. As such, with the first aspect of the present invention, it is possible to control the temperature 2 and the temperature T3 with high precision and to improve the quality of a product. Therefore, according to the first aspect of the present invention, it is possible to provide a manufacturing method of a hot-rolled steel sheet by which a hot-rolled steel sheet having a fine structure and excellent mechanical properties and surface properties can be manufactured at low cost.

Further, in the first aspect of the present invention, the heating device (5, 14) is used to increase the temperature of the material (1) to be rolled up to 1100° C. or more; thereby when the material to be rolled contains Si, an oxide generated at the boundary between the base material and the oxidized scales can be melted, and therefore the oxidized scales can be easily removed. As a result, the surface properties can be easily improved. In addition, by including especially the induction heating device (5) in the heating device, it is possible to easily heat the area intensively in which the temperature has declined, therefore enabling the temperature T1 to be controlled with high precision and energy costs to be easily reduced. Moreover, in the first aspect of the present invention, the roughing mill (3) and the coilbox (4) can be used; and especially with the coilbox (4), the temperature decrease in the tail end portion of the material to be rolled can be prevented. Therefore, it is possible to reduce the energy necessary for increasing the temperature T1 to a target temperature and easily reduce the equipment costs and the energy costs. Additionally in the first aspect of the present invention, the temperature T1, temperature T2, and temperature T3 are controlled based on a detection result of a temperature of the material (1) to be rolled which is detected by the temperature detecting device (10); thereby the temperature T1, temperature T2, and temperature T3 can be easily controlled with high precision.

In the second aspect of the present invention, the control device (20) is provided which controls the operations of the heating device (5, 14), cooling device (8), and rapid cooling device (9) to control the temperature T1, temperature T2, and temperature T3. Therefore, according to the second aspect of the present invention, it is possible to provide a manufacturing apparatus (30, 31, 32) of a hot-rolled steel sheet with which a hot-rolled steel sheet having a fine structure and excellent mechanical properties and surface properties can be manufactured at low cost.

Further, in the second aspect of the present invention, the heating device (5, 14) is used to increase the temperature of the material (1) to be rolled up to 1100° C. or more; thereby when the material to be rolled contains Si, an oxide generated at the boundary between the base material and the oxidized scales can be melted and therefore the oxidized scales can be easily removed. As a result, the surface properties can be easily improved. In addition, by including especially the induction heating device (5) in the heating device, it is possible to easily heat the area intensively in which the temperature has declined, therefore enabling the temperature T1 to be controlled with high precision and energy costs to be easily reduced. Moreover, the roughing mill (3) and the coilbox (4) may be used in the second aspect of the present invention as well; and especially with the coilbox (4), the temperature decrease in the tail end portion of the material to be rolled can be prevented. Therefore, it is possible to reduce the energy necessary for increasing the temperature T1 to a target temperature and to easily reduce the equipment costs and the energy costs. Additionally in the second aspect of the present invention, the temperature T1, temperature T2, and temperature T3 are controlled based on a detection result of a temperature of the material (1) to be rolled which is detected by the temperature detecting device (10); thereby the temperature T1, temperature T2, and temperature T3 can be easily controlled with high precision.

MODES FOR CARRYING OUT THE INVENTION

Figure 1:
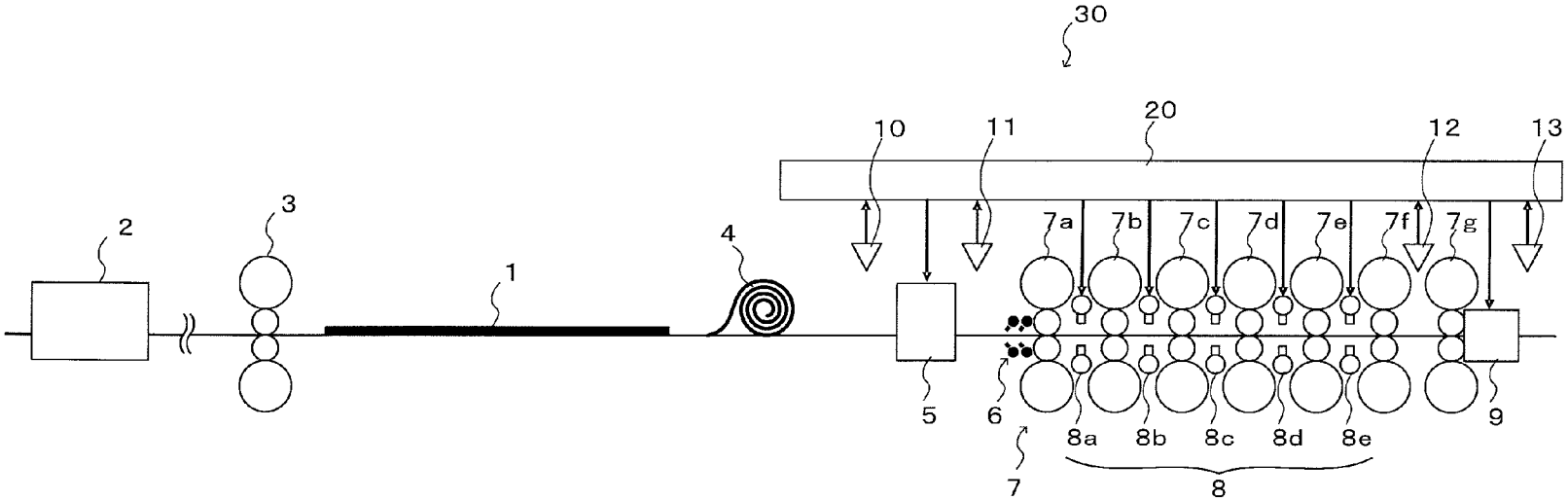
FIG. 1 is a view illustrating a configuration of a manufacturing apparatus 30 of a hot-rolled steel sheet according to the present invention.

Hereinafter, the modes for carrying out the present invention will be described with reference to the drawings. It should be noted that the following modes shown in the drawings are examples of the present invention, and thus the present invention is not limited to these modes. In the below descriptions, the downstream side in the transporting direction of the material to be rolled is simply referred to as a "downstream side", and the upstream side in the transporting direction of the material to be rolled is simply referred to as an "upstream side"

FIG. 1 is a simplified conceptual view of the configuration of the manufacturing apparatus 30 of a hot-rolled steel sheet of the present invention (hereinafter, sometimes simply referred to as a "manufacturing apparatus 30"). In FIG. 1, the material 1 to be rolled transfers in a direction from the left side to the right side of FIG. 1. As shown in FIG. 1, the manufacturing apparatus 30 which manufactures a hot-rolled steel sheet by rolling the material 1 comprises: a roughing mill 3; a coilbox 4 arranged on the downstream side of the roughing mill 3; a temperature sensor 10 arranged on the downstream side of the coilbox 4; a heating device 5 arranged on the downstream side of the temperature sensor 10; a row 7 of finishing mills comprising stands 7*a* to 7*g* arranged on the downstream side of the heating device 5; a descaling device 6 arranged on the entry side (upstream side) of the row 7 of finishing mills; a temperature sensor 11 arranged between the heating device 5 and the descaling device 6; a cooling device 8 disposed in the row 7 of finishing mills; a temperature sensor 12 arranged between the stand 7*f* and the stand 7*g*; a rapid cooling device 9 arranged on the downstream side of the row 7 of finishing mills; and a temperature sensor 13 arranged on the downstream side of the rapid cooling device 9. The manufacturing apparatus 30 further comprises a control device 20 capable of controlling the operations of the heating device 5, cooling device 8, and rapid cooling device 9.

In the manufacturing apparatus 30, the roughing mill 3 is equipment which roughly rolls a slab taken out of a heating furnace 2, into a rough bar having a predetermined thickness. The rough bar roughly rolled by the roughing mill 3 will be coiled by the coilbox 4; and by inhibiting discharge of heat from the rough bar, the temperature decrease of the rough bar is prevented. After the rough bar that has been coiled is removed from the coilbox 4, the temperature thereof will be measured by the temperature sensor 10 and the rough bar will pass through the heating device 5 to reach the row 7 of finishing mills. The row 7 of finishing mills is a tandem mill; and the seven stands 7*a* to 7*g* continuously roll the rough bar, thereby making it a rolled material having a predetermined finished thickness. The material rolled by the row 7 of finishing mills is thereafter cooled by the rapid cooling device 9.

The heating device 5 is a device for heating the rough bar removed from the coilbox 4, and increases the temperature of the rough bar by heating it in the entire sheet thickness direction by a known method such as induction heating. Further, the cooling device 8 comprises: a cooling device 8*a* disposed between the stand 7*a* and the stand 7*b*; a cooling device 8*b* disposed between the stand 7*b* and the stand 7*c*; a cooling device 8*c* disposed between the stand 7*c* and the stand 7*d*; a cooling device 8*d* disposed between the stand 7*d* and the stand 7*e*; and a cooling device 8*e* disposed between the stand 7*e* and the stand 7*f*. The cooling devices 8*a*, 8*b*, 8*c*, 8*d*, and 8*e* spray cooling water over the material to be rolled in the entire sheet thickness direction, thereby decreasing the temperature of the material to be rolled. The rapid cooling device 9 is disposed on the exit side of the final stand 7*g* in the row 7 of finishing mills; at least a part of the rapid cooling device is disposed in the final stand 7*g*; and the rapid cooling device sprays cooling water all over the material rolled in the sheet thickness direction from both surfaces of the steel sheet at a water volume density of 10 $m^3/(m^2 \cdot min)$ or more for one face of the steel sheet, thereby decreasing the temperature of the material rolled. In the manufacturing apparatus 30, the heating device 5, cooling device 8, and rapid cooling device 9 are properly operated, thereby controlling the temperature T1 of the material 1 to be rolled which is on the entry side of the row 7 of finishing mills (upstream side of the stand 7*a*), the temperature T2 of the material 1 to be rolled which is on the entry side of the final stand in the row 7 of finishing mills (upstream side of the stand 7*g*), and the temperature T3 of the material 1 to be rolled which is on the exit side of the rapid cooling device 9.

The control device 20 is a device for controlling the operations of the heating device 5, cooling device 8, and rapid cooling device 9 based on the results of the temperature of the rough bar detected by the temperature sensor 10.

The temperature of the rough bar detected by the temperature sensor 10 is sampled by the control device 20 in accordance with each sampling point given at a fixed pitch in the longitudinal direction of the rough bar.

Next, the control device 20 calculates the timing at which each of the sampling points of the rough bar reaches the exit side of the heating device 5, the entry side of the final stand 7*g* in the row 7 of finishing mills, and the exit side of the rapid cooling device 9, based on the set value of a transporting speed pattern of the transporting table between the roughing mill 3 and the row 7 of finishing mills and the set value of a rolling speed pattern of the row 7 of finishing mills, which values have been transmitted from a comprehensive calculator of a rolling line not shown (a process computer which monitors an entire rolling line and outputs information on the material to be rolled, rolling information, and the like). In addition, using the sheet thickness of the rough bar and the set value of the sheet thickness in the row 7 of finishing mills transmitted from the comprehensive calculator of a rolling line, and with the temperature of the rough bar detected by the temperature sensor 10 as an initial value, the temperature at a time when the sampling point reaches each of the exit side of the heating device 5, the entry side of the final stand 7*g* in the row 7 of finishing mills, and the exit side of the rapid cooling device 9 are predicted by calculation based on the below formulas (1) to (9).

$$T1c=T0+\Delta TBH-\Delta Ta \quad \text{Formula (1)}$$

$$T2c=T1c-\Delta Ts-\Delta Ta-\Delta Tr+\Delta Tq \quad \text{Formula (2)}$$

$$T3c=T2c-\Delta Tc-\Delta Ta-\Delta Tr \quad \text{Formula (3)}$$

$$\Delta TBH=P/(c \cdot p \cdot H \cdot B \cdot V) \quad \text{Formula (4)}$$

$$\Delta Ts=hs \cdot (T-Tw) \cdot tw/(c \cdot \rho \cdot H) \quad \text{Formula (5)}$$

$$\Delta Tc=hc \cdot (T-Tw) \cdot tw/(c \cdot p \cdot H) \quad \text{Formula (6)}$$

$$\Delta Ta=ha \cdot (T-Ta) \cdot ta/(c \cdot \rho \cdot H) \quad \text{Formula (7)}$$

$$\Delta Tr=hr \cdot (T-Tr) \cdot tr/(c \cdot \rho \cdot H) \quad \text{Formula (8)}$$

$$\Delta Tq=G \cdot n/(c \cdot p \cdot H) \quad \text{Formula (9)}$$

In the formulas (1) to (9), T1*c* represents the temperature [° C.] on the exit side of the heating device 5. T2*c* represents the temperature [° C.] on the entry side of the final stand 7*g* in the row 7 of the finishing mills. T3*c* represents the temperature [° C.] on the exit side of the rapid cooling device 9. T0 represents the initial temperature [° C.] of the rough bar. ΔTBH represents an amount of temperature increase [° C.] by the heating device 5. ΔTs represents an amount of temperature decrease [° C.] by the cooling device 8. ΔTc represents an amount of temperature decrease [° C.] by the rapid cooling device 9. ΔTa represents an amount of temperature decrease [° C.] by air cooling. ΔTr represents an amount of temperature decrease [° C.] by contact with the roll. ΔTq represents an amount of temperature increase [° C.] by a heat at the time of rolling process. tw, ta, tr represent water cooling, air cooling, and the time [s] required for finish rolling, respectively; and each of these is calculated from the speed pattern of the row 7 of finishing mills and the transferring table. Tw represents the temperature [° C.] of cooling water sprayed from the cooling device 8 and the rapid cooling device 9. Ta represents the temperature [° C.] of the air. Tr represents the surface temperature [° C.] of the rolls in the row 7 of finishing mills. hs, hc, ha, hr represent water cooling, water cooling, air cooling, and a heat transfer coefficient [W/($m^2$·° C.)] by contact with the rolls in the row 7 of finishing mills, respectively. c, ρ, H represent a specific heat [J/kg·° C.], a density [kg/$m^3$], a thickness [m] of the material 1 to be rolled, respectively. G represents a roll torque [N·m]. η represents a rate at which the roll torque changes to the heat generated by rolling processing. P represents an effective output [W] of the heating device 5. B represents the sheet width [m] of the material to be rolled. V represents the speed at which the rough bar passes through the heating device 5.

In the manufacturing apparatus 30, the control device 20 calculates the temperature using the above formulas (1) to (9), and thereby calculates the amount of temperature increase of the rough bar caused by the heating device 5 (the amount of temperature increase necessary to make the temperature T1 a target value), the amount of temperature decrease of the material 1 to be rolled caused by the cooling device 8 (the amount of temperature decrease necessary to make the temperature T2 a target value), and the amount of temperature decrease of the material 1 to be rolled caused by the rapid cooling device 9 (the amount of temperature decrease necessary to make the temperature T3 a target temperature). In the present invention, the amount of temperature increase is adjusted by adjusting the effective output P of the heating device 5; and the amount of temperature decrease is adjusted by adjusting the amount of cooling water sprayed from the cooling device 8 and the rapid cooling device 9.

Further in the present invention, if the effective output P of the heating device 5 is adjusted so as to reduce the difference between the value detected by the temperature sensor 11 and a target value of the temperature T1, the temperature can be controlled with higher precision. Likewise, by adjusting the amount of cooling water of the cooling device 8 using the value detected by the temperature sensor 12, it is possible to control the temperature T2 with high precision; and by adjusting the amount of the cooling water of the rapid cooling device 9 using the value detected by the temperature sensor 13, it is possible to control the temperature T3 with high precision.

In this way, according to the present invention, the heating device 5 is properly operated based on the temperature of the rough bar detected by the temperature sensor 10, and thereby the temperature T1 of the material 1 to be rolled which is on the entry side of the row 7 of finishing mills can be controlled to a target temperature. Subsequently, the cooling device 8 is properly operated, and thereby the temperature T2 of the material 1 to be rolled which is on the entry side of the final stand 7*g* in the row 7 of finishing mills can be controlled to a target temperature. In addition, the rapid cooling device 9 is properly operated, and thereby the temperature T3 of the material 1 to be rolled can be controlled to a target temperature.

By controlling the temperature T1 to a target temperature, the oxidized scales on the surface of the material 1 to be rolled can be easily removed by the descaling device 6. Further, by controlling the temperatures T2 and T3 to target temperatures, it is possible to manufacture a steel sheet having a fine and uniform structure.

Therefore, according to the present invention, it is possible to provide a manufacturing method of a hot-rolled steel sheet having favorable surface properties and a fine and uniform structure, and to provide a manufacturing apparatus 30 to which the manufacturing method can be applied.

Further, the manufacturing apparatus 30 is provided with the coilbox 4, and thus the temperature decrease in the tail end portion of the rough bar can be inhibited. It is therefore possible to limit the amount of heat required in the heating device 5 to a relatively small amount. Accordingly, large-sized heating equipment is not needed, and thus with the present invention equipment costs and energy costs can be reduced. Further, according to the present invention, it is not necessary to perform accelerated rolling, and therefore changes in the finish rolling speed that can be a disturbance to temperature control do not occur. As such, with the present invention, the temperature T2 and the temperature T3 can be controlled with high precision, and a hot-rolled steel sheet with excellent mechanical properties and surface properties can be manufactured.

It should be noted that the configuration of the rapid cooling device 9 is not particularly restricted as long as it is capable of cooling the material 1 to be rolled which is positioned on the exit side of the row 7 of finishing mills. However, in order to enable manufacturing of a hot-rolled steel sheet having ferrite crystal grains with an average grain size of for example 2 μm or less (hereinafter referred to as "ultra fine grain steel") and for some other purposes, the rapid cooling device 9 is preferably configured to be capable of rapidly cooling the material to be rolled at a cooling rate of 600° C./s or more within 0.2 seconds after completion of rolling by the stand 7*g*. With such a configuration of the rapid cooling device 9, it is possible to provide a manufacturing method of a hot-rolled steel sheet by which ultra fine grain steel with improved surface properties can be manufactured, and to provide a manufacturing apparatus 10 to which this manufacturing method can be applied.

Further, the specific heat in the above formulas (4) to (9) is affected by the quality (component) of the material to be rolled and also varies according to the temperature of the steel sheet. This is because when the steel sheet is cooled and the temperature thereof declines, the crystal structure of the steel sheet transforms from an austenite phase to a ferrite phase and because the specific heat differs between the austenite phase and the ferrite phase and the temperature for the transformation differs depending on the quality (component) of the material to be rolled. Therefore, in the present invention, in view of enabling more accurate calculation of the temperature, and the like, it is preferable to vary the value of the specific heat based on the quality and the temperature of the material to be rolled.

EXAMPLES

The manufacturing conditions of a hot-rolled steel sheet according to the present invention will be described below. A simulation of manufacturing a high tensile steel sheet using the manufacturing apparatus 30 shown in FIG. 1, the manufacturing apparatus 31 shown in FIG. 2, and the manufacturing apparatus 32 shown in FIG. 3 was conducted, the high tensile steel sheet having a product sheet thickness of 2 mm, a product sheet width of 1000 mm, and a product weight of 15 t and containing 0.10 mass % of carbon, 1.00 mass % of manganese, and 0.05 mass % of silicon (Examples 1 to 3).

The finish rolling conditions were set as follows: the row 7 of finishing mills having seven stands; a distance 5.5 m between each of the stands; and a rolling reduction of 30% in the three stands 7*e* to 7*g* on the latter stage side. Further, the rolling time interval between the final stand 7*g* in the row 7 of finishing mills and the stand 7*f* next thereto on the upstream side was set at 0.76 seconds to be suitable for accumulating rolling strains.

In Example 1, a simulation using the manufacturing apparatus 30 was carried out under the above manufacturing conditions. A slab was heated to a predetermined temperature by the heating furnace 2, and was rolled to a predetermined thickness by the roughing mill 3 to produce a rough bar. After the rough bar was coiled by the coilbox 4, it was removed therefrom to be rolled in the row 7 of finishing mills, but it was heated to a predetermined temperature (T1) by the heating device 5 arranged before the row 7 of finishing mills. This heating device 5 was an induction heating device, having a high heating efficiency and occupying a small space in the manufacturing line. The heated rough bar was rolled into a predetermined thickness in the row 7 of finishing mills and cooled by the cooling device 8 to a predetermined temperature (T2) before the final stand 7*g* in the row 7 of finishing mills; thereafter, it was cooled by the rapid cooling device 9 to have a predetermined temperature (T3) on the exit side of the rapid cooling device.

Figure 2:
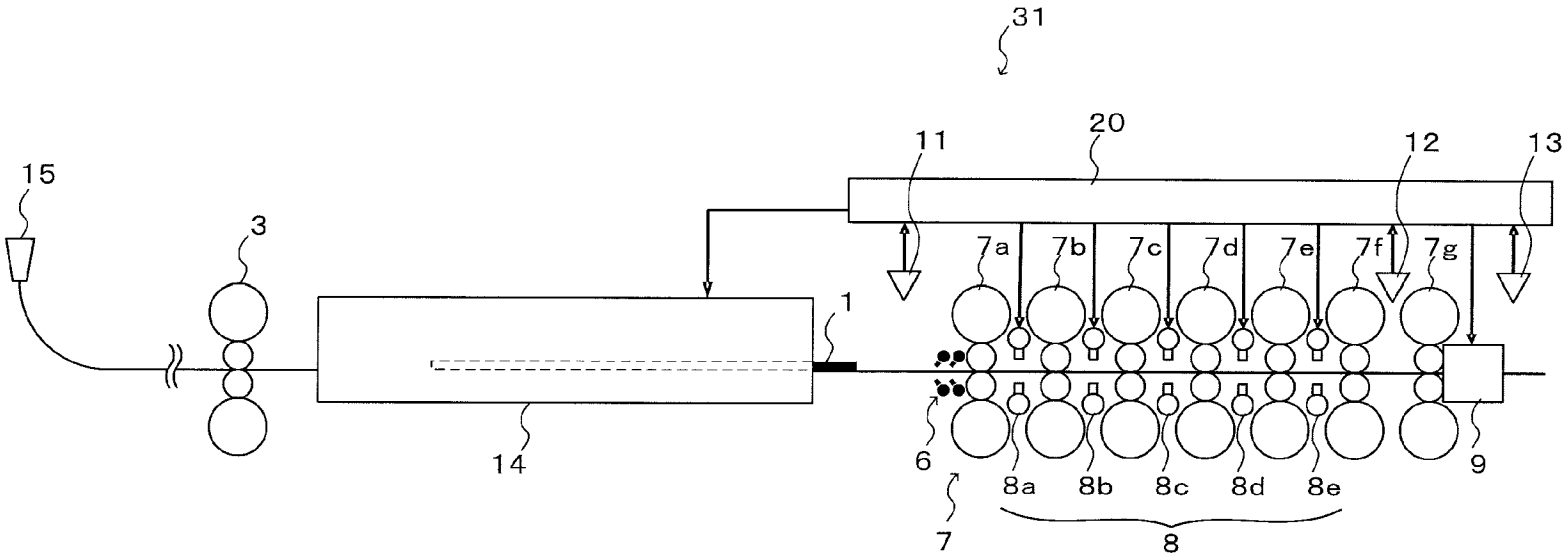
FIG. 2 is a view illustrating a configuration of a manufacturing apparatus 31 of a hot-rolled steel sheet according to the present invention.

In Example 2, a simulation using the manufacturing apparatus 31 shown in FIG. 2 was carried out under the above manufacturing conditions. In the manufacturing apparatus 31, a slab casted by a thin slab continuous casting device 15 was rolled into a predetermined thickness by the roughing mill 3 to produce a rough bar. The rough bar was heated to a predetermined temperature (T1) by the heating device 14 arranged before the row 7 of finishing mills. This heating device 14 was a gas burning furnace. The heating capability thereof per unit area was smaller compared with the heating device 5 of the induction heating type. However, since the heating device 14 was a long furnace, it was capable of increasing the temperature up to a necessary temperature. The procedures from the entry side of the row 7 of finishing mills were the same as in Example 1.

Figure 3:
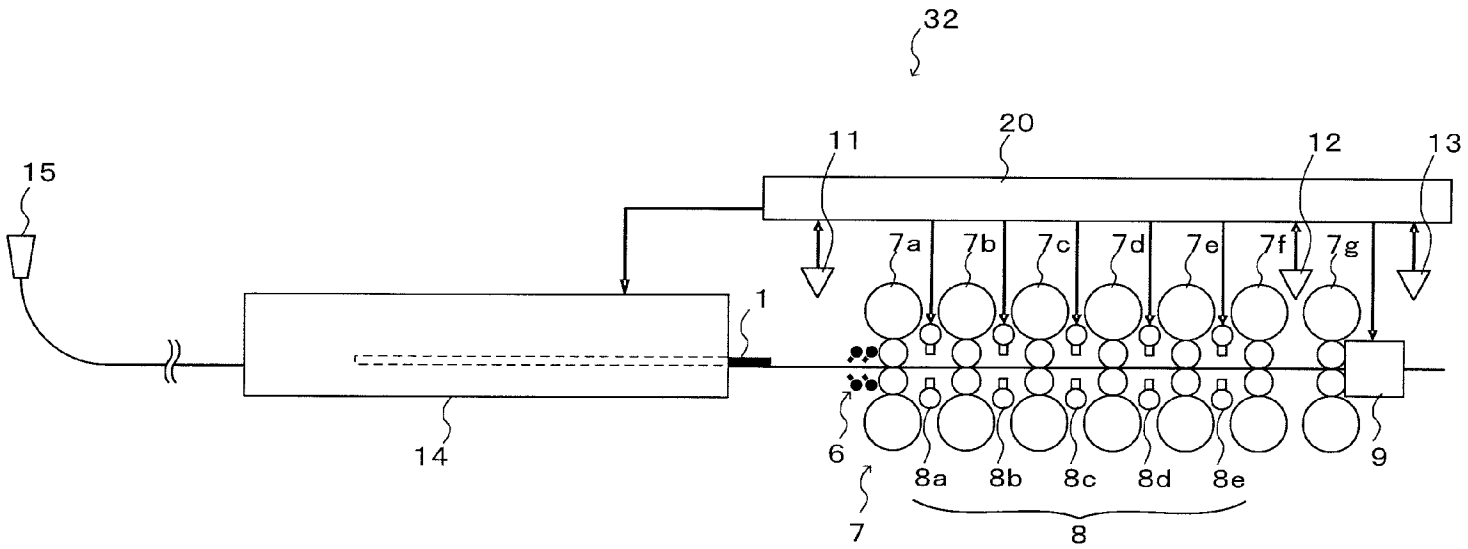
FIG. 3 is a view illustrating a configuration of a manufacturing apparatus 32 of a hot-rolled steel sheet according to the present invention.

In Example 3, a simulation using the manufacturing apparatus 32 shown in FIG. 3 was carried out under the above manufacturing conditions. In the manufacturing apparatus 32, a slab casted by the thin slab manufacturing device 15 did not undergo the rough rolling process but was heated to a predetermined temperature (T1) by the heating device 14 arranged before the row 7 of finishing mills. This heating device 14 was the same as the heating device in Example 2 and the procedures from the entry side of the row 7 of finishing mills were the same as in Example 1.

The simulation conditions of Examples 1 to 3 are shown in Tables 1 to 3; and the results of the average ferrite grain diameters of the manufactured steel sheets according to Examples 1 to 3 are shown in Table 3. The heating efficiency of the heating device indicated in Table 3 shows a ratio between the heating efficiency of the induction heating device and the heating efficiency of the gas burning furnace. Herein, the heating efficiency refers to a ratio between the energy provided to the heating device and the thermal energy given to the steel sheet. The gas burning furnace (heating device 14) used in Examples 2 and 3 had a large amount of heat leaking out of the furnace body. Therefore, the heating efficiency thereof remained at 43% of the heating efficiency of the induction heating device (heating device 5) used in Example 1. Since the manufacturing apparatus 32 used in Example 3 did not comprise a roughing mill, a temperature after rough rolling was not assumed. Thus in Example 3, as the equivalent to the temperature after rough rolling, the temperature (1000° C.) of the material to be rolled which is on the entry side of the heating device 14 is shown in the column of "after rough rolling" in Table 1. Likewise, a sheet thickness after rough rolling was not assumed. Thus in Example 3, as the equivalent to the thickness after rough rolling, the sheet thickness (50 mm) of the material to be rolled which is on the entry side of the heating device 14 is shown in the column of "after rough rolling" in Table 2.

Further, the simulation conditions of Comparative Example 1 adopting the manufacturing method described in Patent Document 1 and of Comparative Example 2 adopting the manufacturing method described in Patent Document 2 are shown in Tables 1 to 3. The result of the average ferrite grain diameter of the manufactured steel sheet according to Comparative Example 1 is shown in Table 3. In Comparative Examples 1 and 2, an induction heating device was used. Although Comparative Example 2 is not a manufacturing method of fine grain steel, it is used for comparison as a technique of simultaneously controlling the temperature on the entry side of the finishing mill and the temperature on the exit side of the finishing mill. Since Comparative Example 2 is not a manufacturing method of fine grain steel, a result of an average ferrite grain diameter of the manufactured steel sheet is not shown.

TABLE 1

| | Temperature [° C.] | | | | | |
|---|---|---|---|---|---|---|
| | After rough rolling | After cooling rough bar | Entry side of row of finishing mills (T1) | Entry side of final stand in row of finishing mills (T2) | Exit side of row of finishing mills | Exit side of rapid cooling device (T3) |
| Example 1 | 1050 | — | 1100 | 860 | — | 600 |
| Example 2 | 1000 | — | 1100 | 860 | — | 600 |
| Example 3 | 1000 | — | 1100 | 860 | — | 600 |
| Comparative Example 1 | 1050 | 350 | 1100 | 860 | — | 600 |
| Comparative Example 2 | 1050 | — | 1100 | — | 840 | — |

TABLE 2

| | Sheet thickness [mm] | | Speed [m/min] Speed of steel sheet on exit side of row of finishing mills |
|---|---|---|---|
| | After rough rolling | After finish rolling | |
| Example 1 | 35 | 2 | 620 |
| Example 2 | 35 | 2 | 620 |
| Example 3 | 50 | 2 | 620 |

TABLE 2-continued

| | Sheet thickness [mm] | | Speed [m/min] Speed of steel sheet on exit |
|---|---|---|---|
| | After rough rolling | After finish rolling | side of row of finishing mills |
| Comparative Example 1 | 15 | 2 | 620 |
| Comparative Example 2 | 35 | 2 | 620 |

TABLE 3

| | Heating device | | | | Rapid cooling | |
|---|---|---|---|---|---|---|
| | Necessary capacity of heating device [kW] | Necessary heating energy [MJ] | Heating efficiency | Cooling device Number of headers used | device Rapid cooling rate [° C./s] | Average ferrite grain diameter of manufactured steel sheet |
| Example 1 | 5070 | 471.3 | — | 2 | 900 | 2 |
| Example 2 | 5649 | 1100 | 43% of Example 1 | 2 | 900 | 2 |
| Example 3 | 4615 | 1100 | 43% of Example 1 | 2 | 900 | 2 |
| Comparative Example 1 | 86120 | 8012.9 | — | 0 | 300 | 2 |
| Comparative Example 2 | 12160 | 801.2 | — | 2 | — | — |

As shown in Table 1, the examples of the present invention in Examples 1 to 3, and Comparative Example 1 showed the same average ferrite grain diameter of the manufactured steel sheet, which was 2 μm. However, in the examples of the present invention, it was unnecessary to cool and reheat the rough bar; therefore, the equipment capacity of the heating device and the energy required for heating were much smaller than those in Comparative Example 1, thus enabling reduction of costs for manufacturing a steel sheet to a small degree.

Next, even in comparison with Comparative Example 2, Example 1 obviously showed a smaller equipment capacity of the heating device and a smaller amount of energy required for heating. Even when seen as a technique of controlling the temperatures of the material to be rolled on the entry side and the exit side of the row of finishing mills, the present invention was superior to Comparative Example 2. Further, Examples 2 and 3 were less favorable than Example 1 and Comparative Example 2 in terms of the necessary heating energy of the heating device. However, Examples 2 and 3 have an advantage that the equipment costs are low, thus can still be adopted.

The present invention has been described above as to the embodiment which is supposed to be practical as well as preferable at present. However, it should be understood that the present invention is not limited to the embodiment disclosed in the specification of the present application and can be appropriately modified within the range that does not depart from the gist or spirit of the invention, which can be read from the appended claims and the overall specification, and a manufacturing method of a hot-rolled steel sheet and a manufacturing apparatus of a hot-rolled steel sheet with such modifications are also encompassed within the technical range of the invention.

INDUSTRIAL APPLICABILITY

The manufacturing method and manufacturing apparatus of a hot-rolled steel sheet of the present invention can be employed in manufacturing a hot-rolled steel sheet such as ultra fine grain steel to be used for automobiles, household electric appliances, and machine structures, and building constructions.

DESCRIPTION OF THE SYMBOLS

1 material to be rolled
2 heating furnace
3 roughing mill
4 coilbox
5 heating device (induction heating device)
6 descaling device
7 row of finishing mills
7*a*, 7*b*, 7*c*, 7*d*, 7*e*, 7*f*, 7*g* finishing mill (stand)
8 cooling device
8*a*, 8*b*, 8*c*, 8*d*, 8*e* cooling device
9 rapid cooling device
10 temperature sensor (temperature detecting device)
11 temperature sensor
12 temperature sensor
13 temperature sensor
14 heating device (gas burning furnace)
15 thin slab continuous casting device
20 control device
30, 31, 32 manufacturing apparatus of hot-rolled steel sheet

The invention claimed is:

1. A manufacturing method of a hot-rolled steel sheet wherein in manufacturing a hot-rolled steel sheet using a heating device which heats a material to be rolled, a descaling device disposed on a more downstream side in a transporting direction of the material to be rolled than the heating device, a row of finishing mills disposed on a more downstream side in the transporting direction of the material to be rolled than the descaling device, a cooling device disposed in the row of finishing mills, and a rapid cooling device of which at a least a part is disposed immediately after a shaft center of a roll of the final stand of the row of finishing mills, the operations of the heating device, cooling device and rapid cooling device are controlled, thereby controlling a temperature T1 of the material to be rolled which is on an entry side of the row of finishing mills, a temperature T2 of the material to be rolled which is on an entry side of a final stand in the row of finishing mills, and a temperature T3 of the material to be rolled which is on an exit side of the rapid cooling device, and the rapid cooling device sprays cooling water all over the material to be rolled in a sheet width direction thereof from both faces of the material to be rolled at a water volume density of 10 $m^3/(m^2 \cdot min)$ or more for one face of the material to be rolled.

2. The manufacturing method of a hot-rolled steel sheet according to claim 1, wherein a temperature of the material to be rolled is increased to 1100° C. or more by using the heating device.

3. The manufacturing method of a hot-rolled steel sheet according to claim 1, wherein an induction heating device and/or a gas burning furnace are included in the heating device.

4. The manufacturing method of a hot-rolled steel sheet according to claim 1, wherein the material to be rolled which is to be heated by the heating device is roughly rolled by a roughing mill disposed on a more upstream side in the transporting direction of the material to be rolled than the heating device.

5. The manufacturing method of a hot-rolled steel sheet according to claim 1, wherein a coilbox which coils the material to be rolled is arranged on a more upstream side in the transporting direction of the material to be rolled than the heating device; and the material to be rolled which has been removed from the coilbox is heated by the heating device.

6. The manufacturing method of a hot-rolled steel sheet according to claim 1, wherein the temperature T1, temperature T2, and temperature T3 are controlled based on a detection result of a temperature of the material to be rolled which is detected by a temperature detecting device disposed on a more upstream side in the transporting direction of the material to be rolled than the heating device.

7. A manufacturing apparatus of a hot-rolled steel sheet comprising:

a heating device which heats a material to be rolled;

a descaling device disposed on a more downstream side in a transporting direction of the material to be rolled than the heating device;

a row of finishing mills disposed on a more downstream side in the transporting direction of the material to be rolled than the descaling device;

a cooling device disposed in the row of finishing mills;

a rapid cooling device of which at least a part is disposed immediately after a shaft center of a roll of the final stand of the row of finishing mills; and a control device capable of controlling the operations of the heating device, cooling device and rapid cooling device, wherein the operations of the heating device, cooling device and rapid cooling device are controlled by the control device, thereby controlling a temperature T1 of the material to be rolled which is on an entry side of the row of finishing mills, a temperature T2 of the material to be rolled which is on an entry side of a final stand in the row of finishing mills, and a temperature T3 of the material to be rolled which is on an exit side of the rapid cooling device, and the rapid cooling device sprays cooling water all over the material to be rolled in a sheet width direction thereof from both faces of the material to be rolled at a water volume density of 10 $m^3/(m^2 \cdot min)$ or more for one face of the material to be rolled.

8. The manufacturing apparatus of a hot-rolled steel sheet according to claim 7, wherein the heating device is capable of increasing a temperature of the material to be rolled to 1100° C. or more.

9. The manufacturing apparatus of a hot-rolled steel sheet according to claim 7, wherein an induction heating device and/or a gas burning furnace are included in the heating device.

10. The manufacturing apparatus of a hot-rolled steel sheet according to claim 7, wherein a roughing mill which roughly rolls the material to be rolled is arranged on a more upstream side in the transporting direction of the material to be rolled than the heating device.

11. The manufacturing apparatus of a hot-rolled steel sheet according to claim 7, wherein a coilbox which coils the material to be rolled is arranged on a more upstream side in the transporting direction of the material to be rolled than the heating device.

12. The manufacturing apparatus of a hot-rolled steel sheet according to claim 7, wherein a temperature detecting device is arranged on a more upstream side in the transporting direction of the material to be rolled than the heating device; and the temperature T1, temperature T2, and temperature T3 are controlled based on a detection result of a temperature of the material to be rolled which is detected by the temperature detecting device.

* * * * *